US006683038B2

(12) United States Patent
Forth et al.

(10) Patent No.: US 6,683,038 B2
(45) Date of Patent: Jan. 27, 2004

(54) LIQUID COMPOSITION COMPRISING POLYALKOXYLATED POLYAMINES OR POLYIMINES

(75) Inventors: Peter Jens Forth, Strombeek (BE); Etinne Maria Betty Andre Jeuniaux, Merchtem (BE); Hilde Christina Jozef Aelbrecht, Merchtem (BE)

(73) Assignee: The Procter & Gamble Company, Cincinnati, OH (US)

( * ) Notice: Subject to any disclaimer, the term of this patent is extended or adjusted under 35 U.S.C. 154(b) by 339 days.

(21) Appl. No.: 09/920,413

(22) Filed: Aug. 1, 2001

(65) Prior Publication Data

US 2002/0045559 A1 Apr. 18, 2002

(51) Int. Cl.[7] ..... C11D 3/30; C11D 3/32

(52) U.S. Cl. ..... 510/296; 510/285; 510/297; 510/304; 510/332; 510/338; 510/341; 510/371; 510/407; 510/413; 510/423; 510/499; 510/501

(58) Field of Search ..... 510/285, 296, 510/297, 304, 332, 338, 341, 371, 407, 413, 423, 499, 501

(56) References Cited

U.S. PATENT DOCUMENTS

| | | | | |
|---|---|---|---|---|
| 4,610,799 | A | | 9/1986 | Wilsberg et al. |
| 4,886,615 | A | | 12/1989 | Dehan |
| 4,973,416 | A | * | 11/1990 | Kennedy ..... 252/90 |
| 6,037,319 | A | | 3/2000 | Dickler et al. |

* cited by examiner

*Primary Examiner*—Charles Boyer
(74) *Attorney, Agent, or Firm*—Armina E. Matthews; Marianna Dressman; Kim William Zerby

(57) ABSTRACT

This invention relates to a pouched liquid composition which comprises an alkoxylated amine, imine, amide or imide compound, small amount of water and specific levels high ionic strength chelating agents.

9 Claims, No Drawings

LIQUID COMPOSITION COMPRISING POLYALKOXYLATED POLYAMINES OR POLYIMINES

CROSS REFERENCE TO RELATED APPLICATIONS

This application claims priority under 35 U.S.C. §119(e) to Great Britain Application Serial No. 0019345.8, filed Aug. 8, 2000 (Attorney Docket No. CM2408F).—

FIELD OF INVENTION

This invention relates to a pouched liquid compositions which comprises an alkoxylated compound having at least two alkoxylated amine, imine, amide or imide groups, small amount of water and specific levels high ionic strength chelating agents.

BACKGROUND TO INVENTION

The laundry industry has been trying to develop ways to make dosing of the detergent products easier. One of method for this is to enclose the detergent in a pouch, such as pouches made from a water-soluble film. Both liquid and solid detergents are known to be delivered to the wash in a easy, safe way. Typically pouch materials are water-soluble films of water-soluble polymers such as derived form polyvinyl alcohol and cellulose.

It is known to incorporate water and other solvents in the compositions in these pouches. One problem associated herewith is that the water-soluble material tends to dissolve in the water in the pouch which weakens the pouch. To address this, the prior art describes that such pouched compositions are to be formulated without any water present. However, the inventors found that one of the problems associated with such compositions in pouches is that these pouches become brittle upon storage. They found that therefor the pouched composition preferably comprises some amount of water and preferably other solvents, to avoid both dissolution and drying out of the water-soluble material of the pouch and thus to avoid the pouches to become either weak or brittle.

However, the problem with liquid compositions comprising such small amounts of water is phase separation of the ingredients.

Separately, the inventors found also that dissolution of the pouch material can negatively impact the cleaning performance of the ingredients in the composition, resulting in poorer performance in the wash, for example poor clay stain removal.

To address the problem of poor stain removal, the inventors found that it is advantages to incorporate alkoxylated compounds, having one or more alkoxylated amine, imine, amide or imide groups, preferably polyalkoxylated polyamine or polyimine in the compositions. However, the use of these compounds can result in an even greater phase separation.

The inventors now found surprisingly that when one or more high ionic strength chelating agent are introduced in the composition, the phase separation can be reduced or even avoided, including phase separation of the specific alkoxylated compounds. This thus allows at the same time the use of low amounts of water, resulting in stable pouches and phase stable compositions, and it allows use of the specific alkoxylated compounds without phase separation, resulting in efficient (clay) stain removal.

This is in particular surprisingly because in isotropic liquid compositions comprising high levels of water, high ionic strength chelating agents can not easily be used, because they tend to crystallise out and cause phase separation. Also, it is generally believed that high ionic strength chelating agents are not compatible with water-soluble material used for the pouches, such as polyvinyl alcohol films.

SUMMARY OF INVENTION

The present invention provides a liquid cleaning composition in a pouch made from a water-soluble material, comprising a) a compound having two or more alkoxylated amine, imine, amide or imide groups;

b) water, present at a level up to 9% by weight of the composition;

c) at least 1.0% by weight of the composition of a chelating agent.

The water-soluble pouch is preferably made of a film comprising PVA.

The water levels in the composition are preferably from 2% to 7.5%; the composition is preferably a laundry composition comprising at least anionic surfactant and fatty acid builder.

The inventors also found that it is in particular beneficial to incorporate in the composition a plasticiser for the water-soluble material of the pouch. They also found that preferably a solvent mixture comprising two or more free hydroxy groups is used

DETAILED DESCRIPTION OF INVENTION

Pouch and Material Thereof

The pouch of the invention, herein referred to as "pouch", is typically a closed structure, made of a water-soluble film described herein, enclosing a volume space which comprises a composition. Said composition is described in more detail hereinafter. The pouch can be of any form, shape and material which is suitable to hold the composition, e.g. without allowing the release of the composition from the pouch prior to contact of the pouch to water. The exact execution will depend on for example, the type and amount of the composition in the pouch, the number of compartments in the pouch, the characteristics required from the pouch to hold, protect and deliver or release the compositions.

The pouch may have one compartment, holding the liquid composition, or it may have a number of compartment, attached to one another or non-attached to one another, thus having one compartment enclosing (but not attaching) another compartment.

The pouch may be of such a size that it conveniently contains either a unit dose amount of the composition herein, suitable for the required operation, for example one wash, or only a partial dose, to allow the consumer greater flexibility to vary the amount used, for example depending on the size and/or degree of soiling of the wash load.

It may be preferred that the water soluble film and preferably the pouch as a whole is stretched during formation and/or closing of the pouch, such that the resulting pouch is at least partially stretched. This is to reduce the amount of film required to enclose the volume space of the pouch. When the film is stretched the film thickness decreases. The degree of stretching indicates the amount of stretching of the film by the reduction in the thickness of the film. For example, if by stretching the film, the thickness of the film is exactly halved then the stretch degree of the stretched film is 100%. Also, if the film is stretched so that the film thickness of the stretched film is exactly a quarter of the thickness of the unstretched film then the stretch degree is exactly 200%. Typically and preferably, the thickness and hence the degree of stretching is non-uniform over the pouch, due to the formation and closing process.

Another advantage of using stretching the pouch, is that the stretching action, when forming the shape of the pouch and/or when closing the pouch, stretches the pouch non-uniformly, which results in a pouch which has a non-uniform thickness. This allows control of the dissolution of water-soluble pouches herein, and for example sequential release of the components of the detergent composition enclosed by the pouch to the water.

Preferably, the pouch is stretched such that the thickness variation in the pouch formed of the stretched water-soluble film is from 10 to 1000%, preferably 20% to 600%, or even 40% to 500% or even 60% to 400%. This can be measured by any method, for example by use of an appropriate micrometer. Preferably the pouch is made from a water-soluble film that is stretched, said film has a stretch degree of from 40% to 500%, preferably from 40% to 200%.

The pouch is typically made from a water-soluble film. It is preferred that the pouch as a whole comprises material which is water-dispersible or more preferably water-soluble. Preferred water-soluble films are polymeric materials, preferably polymers which are formed into a film. The material in the form of a film can for example be obtained by casting, blow-molding, extrusion or blow extrusion of the polymer material, as known in the art.

Preferably the material is water-soluble and has a solubility of at least 50%, preferably at least 75% or even at least 95%, as measured by the method set out hereinafter using a glass-filter with a maximum pore size of 50 microns, namely:

Gravimetric method for determining water-solubility or water-dispersability of the material of the compartment and/or pouch:

50 grams±0.1 gram of material is added in a 400 ml beaker, whereof the weight has been determined, and 245 ml±1 ml of distilled water is added. This is stirred vigorously on magnetic stirrer set at 600 rpm, for 30 minutes. Then, the mixture is filtered through a folded qualitative sintered-glass filter with the pore sizes as defined above (max. 50 micron). The water is dried off from the collected filtrate by any conventional method, and the weight of the remaining polymer is determined (which is the dissolved or dispersed fraction). Then, the % solubility or dispersability can be calculated.

Preferred polymer copolymers or derivatives thereof are selected from polyvinyl alcohols, polyalkylene oxides, acrylic acid, cellulose, cellulose ethers, cellulose esters, polyvinyl acetates, polycarboxylic acids and salts, polyaminoacids or peptides, polyamides, copolymers of maleic/acrylic acids, polysaccharides including starch and gelatine, natural gums such as xanthum and carragum. More preferably the polymer is selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, most preferably polyvinyl alcohols, polyvinyl alcohol copolymers and hydroxypropyl methyl cellulose (HPMC). Preferably, the level of a type polymer (e.g., commercial mixture) in the film material, for example PVA polymer, is at least 60% by weight of the film.

The polymer can have any weight average molecular weight, preferably from about 1000 to 1,000,000, or even form 10,000 to 300,000 or even form 15,000 to 200,000 or even form 20,000 to 150,000.

Mixtures of polymers can also be used. This may in particular be beneficial to control the mechanical and/or dissolution properties of the compartment or pouch, depending on the application thereof and the required needs. For example, it may be preferred that a mixture of polymers is present in the material of the compartment, whereby one polymer material has a higher water-solubility than another polymer material, and/or one polymer material has a higher mechanical strength than another polymer material. It may be preferred that a mixture of polymers is used, having different weight average molecular weights, for example a mixture of PVA or a copolymer thereof of a weight average molecular weight of 10,000–40,000, preferably around 20,000, and of PVA or copolymer thereof, with a weight average molecular weight of about 100,000 to 300,000, preferably around 150,000.

Also useful are polymer blend compositions, for example comprising hydrolytically degradable and water-soluble polymer blend such as polylactide and polyvinyl alcohol, achieved by the mixing of polylactide and polyvinyl alcohol, typically comprising 1–35% by weight polylactide and approximately from 65% to 99% by weight polyvinyl alcohol, if the material is to be water-dispersible, or water-soluble.

It may be preferred that the polymer present in the film is from 60–98% hydrolysed, preferably 80% to 90%, to improve the dissolution of the material.

Most preferred are films which are water-soluble and stretchable films, as described above. Highly preferred water-soluble films are films which comprise PVA polymers and that have similar properties to the film known under the trade reference M8630, as sold by Chris-Craft Industrial Products of Gary, Ind. US.

The water-soluble film herein may comprise other additive ingredients than the polymer or polymer material. For example, it may be beneficial to add plasticisers, for example glycerol, ethylene glycol, diethyleneglycol, propylene glycol, sorbitol and mixtures thereof, additional water, disintegrating aids. It may be useful that the pouch or water-soluble film itself comprises a detergent additive to be delivered to the wash water, for example organic polymeric soil release agents, dispersants, dye transfer inhibitors.

The pouch is typically process comprising the steps of contacting a composition herein to a water-soluble film in such a way as to partially enclose said composition to obtain a partially formed pouch, optionally contacting said partially formed pouch with a second water-soluble film, and then sealing said partially formed pouch. Preferably, the pouch is made using a mold, preferably the mold has round inner side walls and a round inner bottom wall. A composition herein may then be poured into the mold, a second water-soluble film may be placed over the mold with the composition and the pouch may then be sealed, preferably the partially formed pouch is heat sealed. The film is preferably stretched during the formation of the pouch.

Liquid Composition

Typically the liquid composition is contained in the inner volume space of the pouch, and it may be divided over one or more compartments of the pouch.

The liquid composition comprises water, up to 9% by weight of the composition, preferably 1% to 8% or even 2% to 7.5% or even 3% to 6% or even 5% by weight of the composition. This is on basis of free water, added to the other ingredients of the composition.

The liquid composition can made by any method and can have any viscosity, typically depending on its ingredients. The liquid composition preferably has a viscosity of 300 to 3000 cps (centipoises), as measured at a rate of 20 $s^{-1}$, more preferably from 300 to 2000 cps or even from 4000 to 600 cps.

The liquid composition preferably has a density of 0.8 kg/l to 1.3 kg/l, preferably around 1.0 to 1.1 kg/l.

The compositions herein are typically cleaning compositions or fabric care compositions, preferably hard surface cleaners, more preferably laundry or dish washing compositions, including pre-treatment or soaking compositions and rinse additive compositions, including fabric enhancers such as softeners, anti-wrinkling agents, perfume compositions. However, preferred are fabric cleaning compositions (laundry detergents).

Alkoxylated Amine, Imine, Amide, Imide Compound

The composition comprises one or more alkoxylated compounds having at least two alkoxylated amine, imine, amide or imide groups.

Preferred are compounds having at least two alkoxylated amine groups.

The alkoxylation group may have one or more alkoxylates, typically more than one, thus forming a chain of alkoxylates, or polyalkoxylation group.

The compound may have two alkoxylation groups or chain, preferably at least 4 or even at least 7 or even at least 10 or even at least 16. Preferred is that the alkoxylation groups are polyalkoxylation groups, (each independently) having an average alkoxylation degree of at least 5, more preferably at least 8, preferably at least 12, up to preferably 80 or even to 50 or even to 25.

The (poly)alkoxylation is preferably a (poly)ethoxylation and/or (poly)propoxylation. Thus, preferred is that the alkoxylation group is a polyethoxylation group or polypropoxylation group, or a (poly)ethoxylation/(poly) propoxyltion group Preferred may be that these compounds are polymers having such groups. When used herein an polymer is a compound having 2 or more repeating monomer units forming a backbone. The alkoxylated polymer herein is preferably such that the alkoxylation groups are not part of the backbone of the polymer, but are alkoxylation groups of the amine, imine, amide or imide in the units forming the backbone, or are alkoxylation groups of other side-groups chemically bound to the backbone.

Said alkoxylated compound is preferably a polyamide, polyimide or more preferably a polyamine or polyime compound, whereby these amide, imide, amine or imine units are present as backbone of the polymer, forming the chain of repeating units. Preferably, these polymers have at least 3 or even 4 or even 5 amide, imide, amine or imine units. Hereby, it may be preferred that only some of the amine or imine are alkoxylated.

It may be preferred that the backbone has also side-chains containing amide, imide, amine or imine groups, which may be alkoxylated.

Preferred are compounds having a weight average molecular weight of 200 to 50,000, preferably to 20,000 or even to 10,000, or even from 350 to 5000 or even to 2000 or even to 1000.

Preferably the composition herein (described in more detail hereinafter) comprises (by weight of the composition) from 0.5% to 15%, more preferably from 0.8% to 10%, more preferably form 1.5% to 8%, more preferably from 2.0% or even 2.5% or even 3% to 6% of said alkoxylated compound. The composition herein may comprise preferably mixtures of the specified compounds.

Preferred backbones, prior to alkoxylation have the general formula:

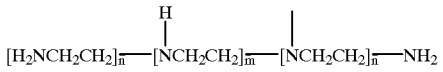

Highly preferred alkoxylated compounds herein are of the following structures:

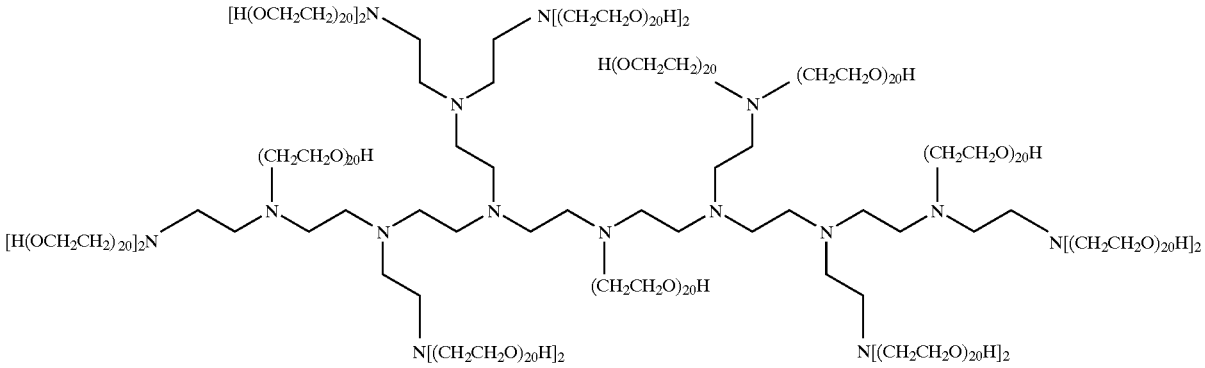

-continued

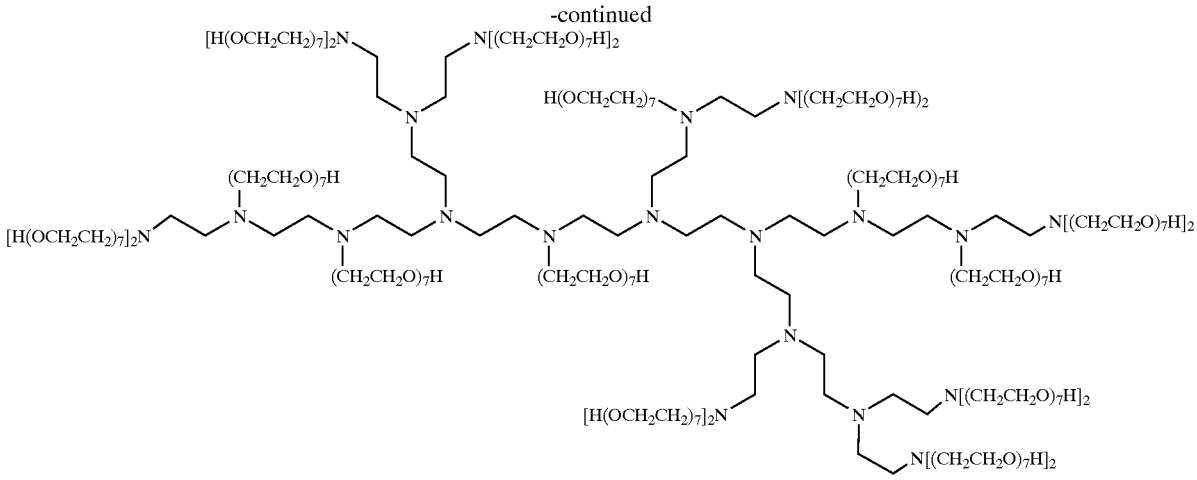

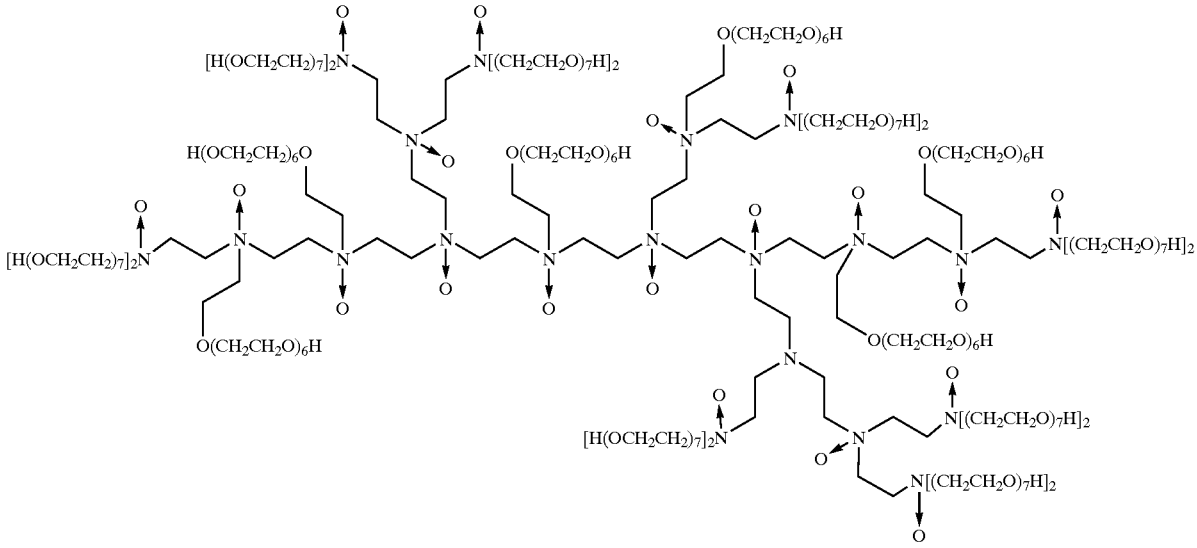

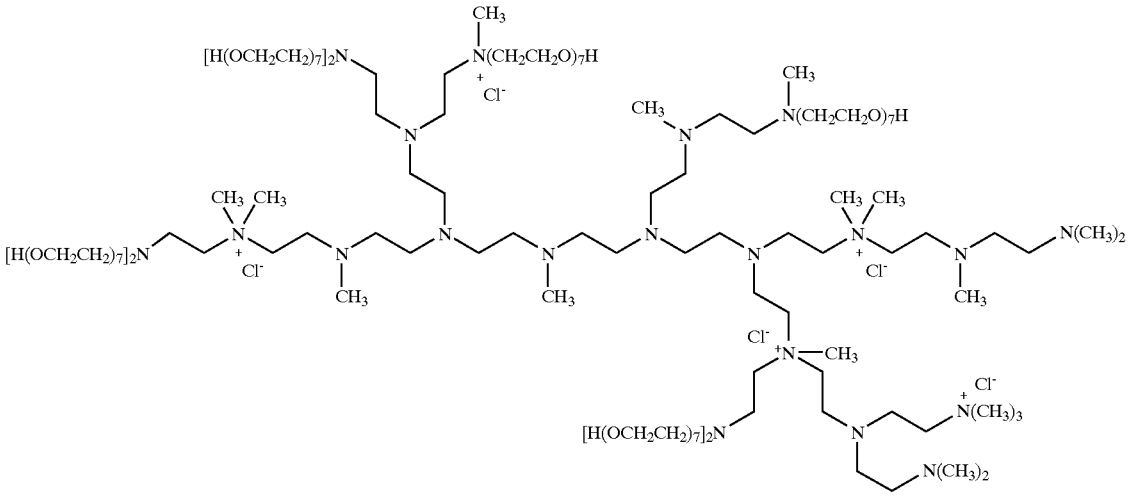

Highly preferred are ethoxylated poly(ethyleneimine), preferably having an average ethoxylationd degree per ethoxylation chain of 15 to 25, and a molecular weight of 1000–2000 dalton.

Also highly preferred are ethoxylated tetraethylene pentaimines.

Chelating Agents

The composition herein comprises a chelating agent, typically a high ionic strength chelating agent, having two or more phosphonic acid or phosphonate groups, or two or more carboxylic acid or carboxylate groups, or mixtures thereof. By chelating agent it is meant herein components which act to sequester (chelate) heavy metal ions, but these components may also have calcium and magnesium chelation capacity.

Chelating agents are generally present at a level of from 1%, preferably from 2.5% from 3.5% or even 5.0% or even 7% and preferably up to 20% or even 15% or even 10% by weight of the composition herein.

Highly suitable organic phosphonates herein are amino alkylene poly (alkylene phosphonates), alkali metal ethane 1-hydroxy bisphosphonates and nitrilo trimethylene phosphonates. Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate.

Other suitable chelating agents for use herein include nitrilotriacetic acid and polyaminocarboxylic acids such as ethylenediaminotetracetic acid, ethylenetriamine pentacetic acid, ethylenediamine disuccinic acid, ethylenediamine diglutaric acid, 2-hydroxypropylenediamine disuccinic acid or any salts thereof. Especially preferred is ethylenediamine-N,N'-disuccinic acid (EDDS) or the alkali metal, alkaline earth metal, ammonium, or substituted ammonium salts thereof, or mixtures thereof. Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable.

Suitable chelating agents with two or more carboxylates or carboxylic acid groups include the acid or salt forms of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Chelants containing three carboxy groups include, in particular, the acids or salt forms of citrates, aconitrates and citraconates as well as succinate derivatives. Preferred carboxylate chelants are hydroxycarboxylates containing up to three carboxy groups per molecule, more particularly citrates and citric acids.

Chelating agents containing four carboxy groups include the salts and acid forms of oxydisuccinates, 1,1,2,2-ethane tetracarboxylates, 1,1,3,3-propane tetracarboxylates and 1,1,2,3-propane tetracarboxylates, sulfosuccinate derivatives.

Highly preferred it that at least one organo phosphonate or phosphonic acid and also at least one di- or tri-carboxylate or carboxylic acid is present. Highly preferred is that at least fumaric acid (or salt) and citric acid (or salt) and one or more phosphonates are present. Preferred salts are sodium salts.

Preferred Ingredients of the Liquid Composition

The preferred amounts of ingredients described herein are % by weight of the composition herein as a whole.

If the liquid composition is a detergent composition, it is preferred that at least a surfactant and builder are present, preferably at least anionic surfactant and preferably also nonionic surfactant, and preferably at least water-soluble builder, preferably at least phosphate builder or more preferably at least fatty acid builder. Preferred is also the presence of enzymes and preferred may also be to incorporate a bleaching agent, such as a preformed peroxyacid.

The liquid composition comprises preferably a colorant or dye and/or pearlescence agent.

Highly preferred are also perfume, brightner, buffering agents (to maintain the pH preferably from 5.5 to 9, more preferably 6 to 8), fabric softening agents, including clays and silicones benefit agents, suds suppressors.

These compounds are described hereinafter in more detail.

In hard-surface cleaning compositions and dish wash compositions, it is preferred that at least a water-soluble builder is present, such as a phosphate, and preferably also surfactant, perfume, enzymes, bleach.

In fabric enhancing compositions, preferably at least a perfume and a fabric benefit agent are present for example a cationic softening agent, or clay softening agent, anti-wrinkling agent, fabric substantive dye.

Highly preferred in all above compositions are also additional solvents, such as alcohols, diols, monoamine derivatives, glycerol, glycols, polyalkylane glycols, such as polyethylene glycol. Highly preferred are mixtures of solvents, such as mixtures of alcohols, mixtures of diols and alcohols, mixtures. Highly preferred may be that (at least) an alcohol, diol, monoamine derivative and preferably even glycerol are present. The compositions of the invention are preferably concentrated liquids having preferably less than 50% or even less than 40% by weight of solvent, preferably less than 30% or even less than 20% or even less than 35% by weight. Preferably the solvent is present at a level of at least 5% or even at least 10% or even at least 15% by weight of the composition. Highly preferred is that the composition comprises, in addition to water, a plasticiser for the water-soluble pouch material, for example one of the plasticisers described above, for example glycerol. Such plasticisers can have the dual purpose of being a solvent for the other ingredients of the composition and a plasticiser for the pouch material.

Anionic Surfactant

The detergent compositions of the invention comprise preferably a surfactant system. Preferably, at least an anionic surfactant is present, preferably at least an sulphonic acid surfactant, such as a linear alkyl benzene sulphonic acid, but salt forms may also be used. Preferably, at least 15% or even at least 20% or even at least 30% by weight of the composition is a surfactant, preferably up to 70% or even 60% or even 50% by weight. Preferably, at least an anionic surfactant and an nonionic surfactant are present in the surfactant system of the composition, preferably in a ratio of 1:2 to 2:1, preferable 1.5:1 to 1:1.5.

The anionic surfactant(s), are preferably present at a level of at least 7.5% by weight of the composition. More preferably anionic surfactant is present at a level of from 10% or even at least 15%, or even from 22.5% by weight of the composition. Anionic sulfonate or sulfonic acid surfactants suitable for use herein include the acid and salt forms of a $C_5$–$C_{20}$, more preferably a $C_{10}$–$C_{16}$, more preferably a $C_{11}$–$C_{13}$ alkylbenzene sulfonates, alkyl ester sulfonates, $C_6$–$C_{22}$ primary or secondary alkane sulfonates, sulfonated polycarboxylic acids, and any mixtures thereof, but preferably $C_{11}$–$C_{13}$ alkylbenzene sulfonates.

Anionic sulphate salts or acids surfactants suitable for use in the compositions of the invention include the primary and secondary alkyl sulphates, having a linear or branched alkyl or alkenyl moiety having from 9 to 22 carbon atoms or more preferably $C_{12}$ to $C_{18}$ alkyl.

Highly preferred are beta-branched alkyl sulphate surfactants or mixtures of commercial available materials, having a weight average (of the surfactant or the mixture) branching degree of at least 50% or even at least 60% or even at least 80% or even at least 95%. It has been found that these branched sulphate surfactants provide a much better viscosity profile, when clays are present, particular when 5% or more clay is present.

It may be preferred that the only sulphate surfactant is such a highly branched alkyl sulphate surfactant, namely referred may be that only one type of commercially available branched alkyl sulphate surfactant is present, whereby the weight average branching degree is at least 50%, preferably at least 60% or even at least 80%, or even at least 90%. Preferred is for example Isalchem, as available form Condea.

Mid-chain branched alkyl sulphates or sulfonates are also suitable anionic surfactants for use in the compositions of the invention. Preferred are the mid-chain branched alkyl sulphates. Preferred mid-chain branched primary alkyl sulphate surfactants are of the formula

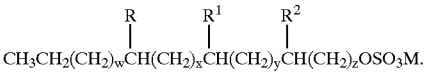

$$CH_3CH_2(CH_2)_wCH(R)(CH_2)_xCH(R^1)(CH_2)_yCH(R^2)(CH_2)_zOSO_3M.$$

These surfactants have a linear primary alkyl sulphate chain backbone (i.e., the longest linear carbon chain which includes the sulphated carbon atom), which preferably comprises from 12 to 19 carbon atoms and their branched primary alkyl moieties comprise preferably a total of at least 14 and preferably no more than 20, carbon atoms. In compositions or components thereof of the invention comprising more than one of these sulphate surfactants, the average total number of carbon atoms for the branched primary alkyl moieties is preferably within the range of from greater than 14.5 to about 17.5. Thus, the surfactant system preferably comprises at least one branched primary alkyl sulphate surfactant compound having a longest linear carbon chain of not less than 12 carbon atoms or not more than 19 carbon atoms, and the total number of carbon atoms including branching must be at least 14, and further the average total number of carbon atoms for the branched primary alkyl moiety is within the range of greater than 14.5 to about 17.5.

Preferred mono-methyl branched primary alkyl sulphates are selected from the group consisting of: 3-methyl pentadecanol sulphate, 4-methyl pentadecanol sulphate, 5-methyl pentadecanol sulphate, 6-methyl pentadecanol sulphate, 7-methyl pentadecanol sulphate, 8-methyl pentadecanol sulphate, 9-methyl pentadecanol sulphate, 10-methyl pentadecanol sulphate, 11-methyl pentadecanol sulphate, 12-methyl pentadecanol sulphate, 13-methyl pentadecanol sulphate, 3-methyl hexadecanol sulphate, 4-methyl hexadecanol sulphate, 5-methyl hexadecanol sulphate, 6-methyl hexadecanol sulphate, 7-methyl hexadecanol sulphate, 8-methyl hexadecanol sulphate, 9-methyl hexadecanol sulphate, 10-methyl hexadecanol sulphate, 11-methyl hexadecanol sulphate, 12-methyl hexadecanol sulphate, 13-methyl hexadecanol sulphate, 14-methyl hexadecanol sulphate, and mixtures thereof.

Preferred di-methyl branched primary alkyl sulphates are selected from the group consisting of: 2,3-methyl tetradecanol sulphate, 2,4-methyl tetradecanol sulphate, 2,5-methyl tetradecanol sulphate, 2,6-methyl tetradecanol sulphate, 2,7-methyl tetradecanol sulphate, 2,8-methyl tetradecanol sulphate, 2,9-methyl tetradecanol sulphate, 2,10-methyl tetradecanol sulphate, 2,1-methyl tetradecanol sulphate, 2,12-methyl tetradecanol sulphate, 2,3-methyl pentadecanol sulphate, 2,4-methyl pentadecanol sulphate, 2,5-methyl pentadecanol sulphate, 2,6-methyl pentadecanol sulphate, 2,7-methyl pentadecanol sulphate, 2,8-methyl pentadecanol sulphate, 2,9-methyl pentadecanol sulphate, 2,10-methyl pentadecanol sulphate, 2,11-methyl pentadecanol sulphate, 2,12-methyl pentadecanol sulphate, 2,13-methyl pentadecanol sulphate, and mixtures thereof.

It is preferred that the anionic surfactants herein are present in the form of sodium salts.

Nonionic Alkoxylated Surfactant

Essentially any alkoxylated nonionic surfactants, which is not an alkoxylated amine, imine, amide or imide compound of the invention, can be comprised by the composition herein. Thus, these nonionic surfactants are then present in addition to the alkoxylated polymer compound of the invention. Ethoxylated and propoxylated nonionic surfactants are preferred. Preferred alkoxylated surfactants can be selected from the classes of the nonionic condensates of alkyl phenols, nonionic ethoxylated alcohols, nonionic ethoxylated/propoxylated fatty alcohols.

Highly preferred are nonionic alkoxylated alcohol surfactants, being the condensation products of aliphatic alcohols with from 1 to 75 moles of alkylene oxide, in particular about 50 or from 1 to 15 moles, preferably to 11 moles, particularly ethylene oxide and/or propylene oxide, are highly preferred nonionic surfactants. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 9 moles and in particular 3 or 5 moles, of ethylene oxide per mole of alcohol.

Polyhydroxy fatty acid amides are highly preferred nonionic surfactant comprised by the composition, in particular those having the structural formula $R^2CONR^1Z$ wherein: R1 is H, $C_{1-18}$, preferably $C_1$–$C_4$ hydrocarbyl, 2-hydroxy ethyl, 2-hydroxy propyl, ethoxy, propoxy, or a mixture thereof, preferable $C_1$–$C_4$ alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ or $C_7$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

Cationic Surfactant

Preferred are also cationic mono-alkoxylated and bis-alkoxylated quaternary amine surfactants with a $C_6$–$C_{18}$ N-alkyl chain, such as of the general formula I:

(I)

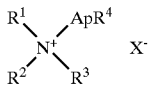

wherein $R^1$ is an alkyl or alkenyl moiety containing from about 6 to about 18 carbon atoms, preferably 6 to about 16 carbon atoms, most preferably from about 6 to about 14 carbon atoms; $R^2$ and $R^3$ are each independently alkyl groups containing from one to about three carbon atoms, preferably methyl, most preferably both $R^2$ and $R^3$ are methyl groups; $R^4$ is selected from hydrogen (preferred), methyl and ethyl; X is an anion such as chloride, bromide, methylsulphate, sulphate, or the like, to provide electrical neutrality; A is a alkoxy group, especially a ethoxy, propoxy or butoxy group; and p is from 0 to about 30, preferably 2 to about 15, most preferably 2 to about 8.

The cationic bis-alkoxylated amine surfactant preferably has the general formula II:

(II)

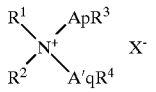

wherein $R^1$ is an alkyl or alkenyl moiety containing from about 8 to about 18 carbon atoms, preferably 10 to about 16 carbon atoms, most preferably from about 10 to about 14 carbon atoms; $R^2$ is an alkyl group containing from one to three carbon atoms, preferably methyl; $R^3$ and $R^4$ can vary independently and are selected from hydrogen (preferred), methyl and ethyl, $X^-$ is an anion such as chloride, bromide, methylsulphate, sulphate, or the like, sufficient to provide electrical neutrality. A and A' can vary independently and are each selected from $C_1$–$C_4$ alkoxy, especially ethoxy, (i.e., —$CH_2CH_2O$—), propoxy, butoxy and mixtures thereof; p is from 1 to about 30, preferably 1 to about 4 and q is from 1 to about 30, preferably 1 to about 4, and most preferably both p and q are 1.

Another suitable group of cationic surfactants which can be used in the detergent compositions are cationic ester surfactants. Suitable cationic ester surfactants, including choline ester surfactants, have for example been disclosed in U.S. Pat. Nos. 4,228,042, 4,239,660 and 4,260,529.

Builder Compounds

The compositions in accord with the present invention preferably contain a water-soluble builder compound, typically present in detergent compositions at a level of from 1% to 60% by weight, preferably from 3% to 40% by weight, most preferably from 5% to 25% by weight of the composition.

Suitable water-soluble builder compounds include the water soluble monomeric carboxylates, or their acid forms, or homo or copolymeric polycarboxylic acids or their salts in which the polycarboxylic acid comprises at least two carboxylic radicals separated from each other by not more that two carbon atoms, and mixtures of any of the foregoing.

Highly preferred maybe that one or more fatty acids and/or optionally salts thereof (and then preferably sodium salts) are present in the detergent composition. It has been found that this can provide further improved softening and cleaning of the fabrics. Preferably, the compositions contain 1% to 25% by weight of a fatty acid or salt thereof, more preferably 6% to 18% or even 10% to 16% by weight. Preferred are in particular $C_{12}$–$C_{18}$ saturated and/or unsaturated fatty acids, but preferably mixtures of such fatty acids. Highly preferred have been found mixtures of saturated and unsaturated fatty acids, for example preferred is a mixture of rape seed-derived fatty acid and $C_{16}$–$C_{18}$ topped whole cut fatty acids, or a mixture of rape seed-derived fatty acid and a tallow alcohol derived fatty acid.

The detergent compositions of the invention may comprise phosphate-containing builder material. Preferably present at a level of from 2% to 40%, more preferably from 3% to 30%, more preferably from 5% to 20%. Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

The compositions in accord with the present invention may contain a partially soluble or insoluble builder compound, typically present in detergent compositions at a level of from 0.5% to 60% by weight, preferably from 5% to 50% by weight, most preferably from 8% to 40% weight of the composition.

Preferred are aluminosilicates and/or crystalline layered silicates such as SKS-6, available from Clariant.

However, from a formulation point of view it may be preferred not to include such builders in the liquid composition, because it will lead to too much dispersed or precipitate material in the liquid, or it requires too much process or dispersion aids.

Perfume

Highly preferred are perfume components, preferably at least one component comprising a coating agent and/or carrier material, preferably organic polymer carrying the perfume or alumniosilicate carrying the perfume, or an encapsulate enclosing the perfume, for example starch or other cellulosic material encapsulate. The inventors have found that the perfumes are more efficiently deposited onto the fabric in the compositions of the invention.

Fabric Softening Clays

Preferred fabric softening clays are smectite clays, which can also be used to prepare the organophilic clays described hereinafter, for example as disclosed in EP-A-299575 and EP-A-313146. Specific examples of suitable smectite clays are selected from the classes of the bentonites—also known as montmorillonites, hectorites, volchonskoites, nontronites, saponites and sauconites, particularly those having an alkali or alkaline earth metal ion within the crystal lattice structure.

Preferably, hectorites or montmorillonites or mixtures thereof. Hectorites are most preferred clays.

The softening clay is preferably present at levels up to 15%, more preferably up to 7% or even up to 10% by weight, typically, at least 3% or even at least 5%. By weight, when the formulation is to be a softening formulation.

The hectorite clays suitable in the present composition should preferably be sodium clays, for better softening activity.

Sodium clays are either naturally occurring, or are naturally-occurring calcium-clays which have been treated so as to convert them to sodium-clays. If calcium-clays are used in the present compositions, a salt of sodium can be added to the compositions in order to convert the calcium clay to a sodium clay. Preferably, such a salt is sodium carbonate, typically added at levels of up to 5% of the total amount of clay.

Examples of hectorite clays suitable for the present compositions include Bentone EW as sold by Elementis.

Another preferred clay is an organophilic clay, preferably a smectite clay, whereby at least 30% or even at least 40% or preferably at least 50% or even at least 60% of the exchangeable cations is replaced by a, preferably long-chain, organic cations. Such clays are also referred to as hydrophobic clays. The cation exchange capacity of clays and the percentage of exchange of the cations with the long-chain organic cations can be measured in several ways known in the art, as for example fully set out in Grimshaw, The Chemistry and Physics of Clays, Interscience Publishers, Inc.,pp. 264–265 (1971).

Whilst the organophilic smectite clay provides excellent softening benefit, they can increase the viscosity of the liquid compositions. Therefore, it will depend on the viscosity requirements of the composition, how much of these organophlic clays can be used. Typically, they are used in the liquid detergent compositions of the invention at a level of from 0.1% to 10%, more preferably from 0.3% to 7%, most preferably from 0.4% to 5% or even 0.5% to 4% by weight of the composition.

These organophilic clays are formed prior to incorporation into the detergent composition. Thus for example, the cations, or part thereof, of the normal smectite clays are replaced by the long-chain organic cations to form the organophilic smectite clays herein, prior to further processing of the material to form the detergents of the invention.

The organophilic clay is preferably in the form of a platelet or lath-shaped particle. Preferably the ratio of the width to the length of such a platelet is at least 1:2, preferably at least 1:4 or even at least 1:6 or even at least 1:8.

When used herein, a long-chain organic cation can be any compound which comprises at least one chain having at least 6 carbon atoms, but typically at least 10 carbon atoms, preferably at least 12 carbon atoms, or in certain embodiments of the invention, at least 16 or even at least 18 carbon atoms. Preferred long-chain organic cations are described hereinafter.

Preferred organophilic clays herein clay are smectite clays, preferably hectorite clays and/or montmorillonite clays containing one or more organic cations of formulae:

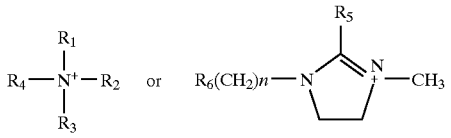

where $R_1$ represents an organic radical selected from $R_7$, $R_7$—CO—O—$(CH_2)_n$, or $R_7$—CO—$NR_8$— in which $R_7$ is an alkyl, alkenyl or alkylaryl group with 12–22 carbon atoms, whereby $R_8$ is hydrogen, $C_1$–$C_4$ alkyl, alkenyl or hydroxyalkyl, preferably —$CH_3$ or —$C_2H_5$ or —H ; n is an integer, preferably equal to 2 or 3; $R_2$ represents an organic radical selected from $R_1$ or $C_1$–$C_4$ alkyl, alkenyl or hydroxyalkyl, preferably —$CH_3$ or —$CH_2CH_2OH$; $R_3$ and $R_4$ are organic radicals selected from $C_1$–$C_4$ alkyl-aryl, $C_1$–$C_4$ alkyl, alkenyl or hydroxyalkyl, preferably —$CH_3$, —$CH_2CH_2OH$, or benzyl group; $R_5$ is an alkyl or alkenyl group with 12–22 carbon atoms; $R_6$ is preferably —OH, —NHCO-$R_7$, or —OCO—$R_7$.

Highly preferred cations are quaternary ammonium cations having two $C_{16}$–$C_{28}$ or even $C_{16}$–$C_{24}$ alkyl chains. Highly preferred are one or more organic cations which have one or preferably two alkyl groups derived from natural fatty alcohols, the cations preferably being selected from dicocoyl methyl benzyl ammonium, dicocoyl ethyl benzyl ammonium, dicocoyl dimethyl ammonium, dicocoyl diethyl ammonium; more preferably ditallow diethyl ammonium, ditallow ethyl benzyl ammonium; more preferably ditallow dimethyl ammonium and/or ditallow methyl benzyl ammonium.

It may be highly preferred that mixtures of organic cations are present.

Highly preferred are organophilic clays as available from Rheox/Elementis, such as Bentone SD-1 and Bentone SD-3, which are registered trademarks of Rheox/Elementis.

Cationic Fabric Softening Agents

Cationic fabric softening agents are preferably present in the composition herein. Suitable cationic fabric softening agents include the water insoluble tertiary amines or dilong chain amide materials as disclosed in GB-A-1 514 276 and EP-B-0 011 340. Preferably, these water-insoluble tertiary amines or dilong chain amide materials are comprised by the solid component of the composition herein.

Cationic fabric softening agents are typically incorporated at total levels of from 0.5% to 15% by weight, normally from 1% to 5% by weight.

Bleaching Agent

Another ingredient which may be present is a perhydrate bleach, such as salts of percarbonates, particularly the sodium salts, and/or organic peroxyacid bleach precursor. It has been found that when the pouch or compartment is formed from a material with free hydroxy groups, such as PVA, the preferred bleaching agent comprises a percarbonate salt and is preferably free form any perborate salts or borate salts. It has been found that borates and perborates interact with these hydroxy-containing materials and reduce the dissolution of the materials and also result in reduced performance.

Inorganic perhydrate salts are a preferred source of peroxide. Preferably these salts are present at a level of from 0.01% to 50% by weight, more preferably of from 0.5% to 30% by weight of the composition or component.

Examples of inorganic perhydrate salts include percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilise a coated form of the material which provides better storage stability for the perhydrate salt in the granular product. Suitable coatings comprise inorganic salts such as alkali metal silicate, carbonate or borate salts or mixtures thereof, or organic materials such as waxes, oils, or fatty soaps.

Alkali metal percarbonates, particularly sodium percarbonate are preferred perhydrates herein. Sodium percarbonate is an addition compound having a formula corresponding to $2Na_2CO_3.3H_2O_2$, and is available commercially as a crystalline solid.

The composition herein preferably comprises a peroxy acid or a precursor therefor (bleach activator), preferably comprising an organic peroxyacid bleach precursor. It may be preferred that the composition comprises at least two peroxy acid bleach precursors, preferably at least one hydrophobic peroxyacid bleach precursor and at least one hydrophilic peroxy acid bleach precursor, as defined herein. The production of the organic peroxyacid occurs then by an in situ reaction of the precursor with a source of hydrogen peroxide.

The hydrophobic peroxy acid bleach precursor preferably comprises a compound having a oxy-benzene sulphonate group, preferably NOBS, DOBS, LOBS and/or NACA-OBS, as described herein.

The hydrophilic peroxy acid bleach precursor preferably comprises TAED, as described herein.

Amide substituted alkyl peroxyacid precursor compounds are suitable herein, including those of the following general formulae:

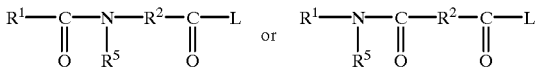

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. Amide substituted bleach activator compounds of this type are described in EP-A-0170386.

The composition may contain a pre-formed organic peroxyacid.

A preferred class of organic peroxyacid compounds are the amide substituted compounds of the following general formulae:

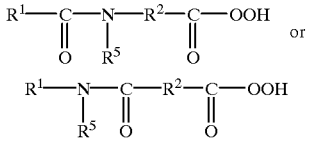

wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. Amide substituted organic peroxyacid compounds of this type are described in EP-A-0170386.

Other organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxicaproic acid are also suitable herein.

Suds Suppressing System

The composition may comprise a suds suppresser at a level less than 10%, preferably 0.001% to 10%, preferably from 0.01% to 8%, most preferably from 0.05% to 5%, by weight of the composition Preferably the suds suppresser is either a soap, paraffin, wax, or any combination thereof. If the suds suppresser is a suds suppressing silicone, then the detergent composition preferably comprises from 0.005% to 0.5% by weight a suds suppressing silicone.

Enzymes

Another preferred ingredient useful in the compositions herein is one or more enzymes.

Preferred enzymatic materials include the commercially available lipases, cutinases, amylases, neutral and alkaline proteases, cellulases, endolases, esterases, pectinases, lactases and peroxidases conventionally incorporated into detergent compositions. Suitable enzymes are discussed in U.S. Pat. Nos. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition.

Preferred amylases include, for example, α-amylases obtained from a special strain of B licheniformis, described in more detail in GB-1,269,839 (Novo). Preferred commercially available amylases include for example, those sold under the tradename Rapidase by Gist-Brocades, and those sold under the tradename Termamyl, Duramyl and BAN by Novo Industries A/S. Highly preferred amylase enzymes maybe those described in PCT/US 9703635, and in W095/26397 and W096/23873.

Amylase enzyme may be incorporated into the composition in accordance with the invention at a level of from 0.0001% to 2% active enzyme by weight of the composition.

Useful additional non-alkoxylated organic polymeric compounds for inclusion in the compositions herein include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 1000–5000 and their copolymers with maleic anhydride, such copolymers having a molecular weight of from 2000 to 100,000, especially 40,000 to 80,000.

Other organic polymeric compounds suitable for incorporation in the detergent compositions herein include cellulose derivatives.

Suitable suds suppressing systems for use herein may comprise essentially any known antifoam compound, including for example silicone antifoam compounds and 2-alkyl alcanol antifoam compounds.

Other suitable antifoam compounds include the monocarboxylic fatty acids and soluble salts thereof, as also described as builders above. These materials are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to 24 carbon atoms, preferably 12 to 18 carbon atoms. Suitable salts include the alkali metal salts such as in particular sodium but also potassium salts.

The compositions herein may also comprise from 0.01% to 10%, preferably from 0.05% to 0.5% by weight of polymeric dye transfer inhibiting agents. The polymeric dye transfer inhibiting agents are preferably selected from polyamine N-oxide polymers, copolymers of N-vinylpyrrolidone and N-vinylimidazole, polyvinylpyrrolidonepolymers or combinations thereof, whereby these polymers can be cross-linked polymers.

The compositions herein also optionally contain from about 0.005% to 5% by weight of certain types of hydrophilic optical brighteners.

Preferred brighteners include 4,4',-bis[(4-anilino-6-(N-2-bis-hydroxyethyl)-s-triazine-2-yl)amino]-2,2'-stilbenedisulfonic acid and disodium salt, commercially marketed under the tradename Tinopal-UNPA-GX by Ciba-Geigy Corporation; 4,4'-bis[(4-anilino-6-(N-2-hydroxyethyl-N-methylamino)-s-triazine-2-yl)amino]2,2'-stilbenedisulfonic acid disodium salt, commercially marketed under the tradename Tinopal 5BM-GX by Ciba-Geigy Corporation; 4,4'-bis[(4-anilino-6-morphilino-s-triazine-2-yl)amino]2,2'-stilbenedisulfonic acid, sodium salt, commercially marketed under the tradename Tinopal-DMS-X and Tinopal AMS-GX by Ciba Geigy Corporation.

Also preferred may be bleaches, neutralizing agents, buffering agents, phase regulants, hydrotropes, enzyme stabilizing agents, opacifiers, anti-oxidants, bactericides, photo-bleaches.

Abbreviations used in Examples

In the detergent compositions, the abbreviated component identifications have the following meanings:

| | |
|---|---|
| LAS | Sodium linear $C_{11-13}$ alkyl benzene sulfonate |
| HSAS | $C_{11-13}$ alkyl benzene sulfonic acid |
| TAS | Sodium tallow alkyl sulphate |
| CxyAS | Sodium $C_{1x}$–$C_{1y}$ alkyl sulphate |
| CxyASz | Sodium $C_{1x}$–$C_{1y}$ alkyl sulphate, having a weight average branching degree of at least z |
| QAS | $R_2.N^+(CH_3)_2(C_2H_4OH)$ with $R_2 = C_{12} - C_{14}$ |
| MBAS | Branched C16–C18 alkylsulphate having an average methyl branching of 1.5 |
| APA | $C_8$–$C_{10}$ amido propyl dimethyl amine |
| Soap | Sodium linear alkyl carboxylate derived from an 80/20 mixture of tallow and coconut fatty acids |
| TPKFA | $C_{16}$–$C_{18}$ topped whole cut fatty acids |
| Citric acid | Anhydrous citric acid |
| Citrate | Tri-sodium citrate dihydrate of activity 86.4% with a particle size distribution between 425 $\mu$m and 850 $\mu$m |
| MA/AA | Copolymer of 1:4 maleic/acrylic acid, average molecular weight about 70,000 |
| Cellulose ether | Methyl cellulose ether with a degree of polymerization of 650 available from Shin Etsu Chemicals |
| EA I | Ethoxylated tetraethylene pentaimine having at least 5 ethoxylation groups, each having an average ethoxylation degree of 15–25. |
| EA II | Ethoxylated imine having at least 10 ethoxylated amine groups, each having an average ethoxylation degree of 15–25. |
| Protease | Proteolytic enzyme, having 3.3% by weight of active enzyme, sold by NOVO Industries A/S under the tradename Savinase |
| Cellulase | Cellulytic enzyme, having 0.23% by weight of active enzyme, sold by NOVO Industries A/S under the tradename Carezyme |
| Amylase | Amylolytic enzyme, having 1.6% by weight of active enzyme, sold by NOVO Industries A/S under the tradename Termamyl 120T |
| Lipase | Lipolytic enzyme, having 2.0% by weight of active enzyme, sold by NOVO Industries A/S under the tradename Lipolase or Lipolase Ultra |
| | Sodium percarbonate of nominal formula $2Na_2CO_3.3H_2O_2$ |
| EDDS | Ethylenediamine-N,N'-disuccinic acid, (S,S) isomer in the form of its sodium salt. |
| HEDP | 1,1-hydroxyethane diphosphonic acid |
| Photoactivated bleach: | Sulfonated zinc phthlocyanine encapsulated in dextrin soluble polymer |
| Brightener | Disodium 4,4'-bis(2-sulphostyryl)biphenyl or Disodium 4,4'-bis(4-anilino-6-morpholino-1.3.5-triazin-2-yl)amino) stilbene-2:2'-disulfonate |
| PVNO | Polyvinylpyridine N-oxide polymer, with an average molecular weight of 50,000 |
| PVPVI | Copolymer of polyvinylpyrolidone and vinylimidazole, with an average molecular weight of 20,000 |
| Clay | Bentone SD-3, as available from Rheox/Elementis, and/or Bentone EW, as available from Rheox/Elementis |
| Opacifier | |

In the following examples all levels are quoted as % by weight of the composition:

EXAMPLE 1

The following liquid composition is in accord with the invention, and is incorporated in a polyvinyl alcohol film, of mono sol material.

| Component | A | B | C |
|---|---|---|---|
| C25AS | — | 20.0 | — |
| HLAS (acid) | 25.0 | 5.0 | 19.0 |
| Citric Acid | 4.0 | 4.5 | 3.0 |
| $C_{12-18}$ Fatty Acid (s) | 16.0 | 22.0 | 18.0 |
| Enzymes | 1.3 | 1.0 | 0.5 |
| QAS | 1.0 | 1.0 | — |
| Propanediol/glycerol/ethanol | 26 | 30 | 27.0 |
| Formic acid | 1.0 | — | — |
| APA | 3.0 | — | 15.0 |
| HEDP or EDDS | 2.0 | 0.8 | 1.25 |
| Clay | 5.0 | — | — |
| Polymer I | 2.6 | 3.0 | — |
| Polymer II | 2.0 | 1.5 | 4.0 |
| Fumaric acid | 3.0 | 2.0 | 2.0 |
| Dye, Perfume, Brighteners, Preservatives, Suds Suppressor, Other Minors, water (N4%) | Balance | Balance | Balance |
| | 100% | 100% | 100% |

EXAMPLE 2

The following liquid detergent formulations are according to the present invention and incorporated in a polyvinyl alcohol film of monosol material.

| | A | B | C |
|---|---|---|---|
| HLAS or LAS | 2.0 | 16.0 | — |
| MBAS | — | 1.8 | 18.0 |
| C25AS | — | 12.0 | 4.0 |
| rape seed oil fatty acid | 3.5 | 5.0 | — |
| APA | 20.0 | — | 10.0 |
| TPKFA | 6.0 | 15.0 | 18.0 |
| Citric acid | 2.0 | 3.0 | 4.01 |
| Glcerol | — | 10.0 | 10.0 |
| Ethanol | 4.0 | 8.0 | — |
| 1,2 Propanediol | 10.0 | 4.0 | 12.0 |
| Monoethanolamine | 3.0 | 5.0 | 4.0 |
| CMC | — | — | 0.5 |
| Clay | 8.0 | — | 6.0 |
| HEDPP/EDDS | 2.0 | 2.0 | 1.0 |
| Polymer I | 2.0 | 3.0 | — |
| Polymer II | 2.0 | 2.0 | 5.0 |
| Protease | 0.2 | 1.0 | 0.9 |
| Lipase | — | — | 0.5 |
| Amylase | 0.4 | 0.5 | 0.3 |
| Cellulase | — | 0.8 | — |
| Fumate | 3.0 | 2.0 | 1.0 |
| Ca chloride | 1.0 | .05 | 0.5 |
| Brightener 1 | 0.5 | 0.4 | 0.5 |
| Suds suppressor | 0.5 | 0.5 | 0.8 |
| Perfume | 1.0 | 1.0 | 1.0 |
| Opacifier | 0.5 | — | 0.5 |
| Minors up to 100% | | | |
| NaOH up to pH 8 | — | — | — |
| water up to balance | | | |

EXAMPLE 3

The following are compositions in accord with the invention.

| | A | B | C |
|---|---|---|---|
| $C2_yAE5$ | 14.0 | 20.0 | 10.0 |
| MBAS/HLAS | 5.0 | — | — |

-continued

| | A | B | C |
|---|---|---|---|
| Citric acid/sodium citrate | 5.0 | 10.0 | 8.0 |
| Phosphate | 5.0 | 10.0 | 5.0 |
| Fatty acid | 5.0 | 10.0 | 5.0 |
| Hydrochlorid acid | 10.0 | — | — |
| Polymer I | 3.0 | 6.0 | 3.0 |
| Polymer II | 5.0 | 2.0 | 3.0 |
| Peroxyacid bleach | — | 15.0 | 15.0 |
| Glycerol | 5.0 | 7.0 | 10.0 |
| Ethanol | 15.0 | 9.0 | 20.0 |
| Monoethandamine | 15.0 | — | 5.0 |
| EDDS/HEDP | 5.0 | 4.0 | 3.0 |
| Water | 6.0 | 5.0 | 4.0 |
| Fumate | — | — | 6.0 |
| Perfume | 1.0 | 0.5 | 1.0 |
| enzymes | — | — | 1.5 |
| Dye | 10 ppm | 10 ppm | 50 ppm |
| Pearlescence | 0.1 | 0.2 | 0.5 |
| Minors to balance to 100% | | | |

What is claimed is:

1. A liquid cleaning composition in a water-soluble pouch comprising a) at least two alkoxylated compounds selected from the group consisting of polyalkoxylated polyamine, polyalkoxylated polyimine, and mixtures thereof;

b) water, present at a level up to 9% by weight;

c) at least 1.0% by weight of a chelating agent.

2. A composition according to claim 1, wherein said water-soluble pouch is made from a film comprising polyvinyl alcohol.

3. A composition as in claim 1 wherein said compounds comprise at least 4 amine or imine groups and at least 4 polyalkoxylation groups each having an average degree of alkoxylation of at least 8.

4. A composition as in claim 1 further comprising an organic solvent mixture comprising at least a compound with one or more free hydroxy groups and/or a plasticiser for the water-soluble pouch, the composition comprising from 2% to 7.5% water.

5. A composition according to claim 4 wherein the organic solvent mixture comprises a diol-compound and glycerine, at a total level of at least 10% by weight of the composition.

6. A composition as in claim 1 comprising from 1 to 60% by weight of the composition of a water soluble builder compound.

7. A composition as in claim 1 further comprising a surfactant system present at a level of at least 30% by weight of the composition and comprises at least an anionic surfactant and an nonionic surfactant, in a ratio of 1:2 to 2:1.

8. A composition according to claim 1 wherein said water-soluble pouch is stretchable, said water-soluble pouch has a stretch degree from 40% to 500%.

9. A composition according to claim 1 further comprising a bleaching agent and/or enzyme.

* * * * *